United States Patent [19]

Frens et al.

[11] Patent Number: 4,939,342

[45] Date of Patent: Jul. 3, 1990

[54] ELECTRIC STEAM IRON WITH SEPARATELY HEATED SOLE PLATE AND STEAM CHAMBER

[75] Inventors: Gerrit Frens, Eindhoven; Gregorius T. M. Neelen, Groningen; Franciscus N. M. Trines, Drachten; Marjoleine H. Van Nieuwkasteele, Eindhoven, all of Netherlands

[73] Assignee: U.S. Philips Corp., New York, N.Y.

[21] Appl. No.: 183,286

[22] Filed: Apr. 11, 1988

Related U.S. Application Data

[63] Continuation of Ser. No. 876,542, Jun. 20, 1986, abandoned.

[30] Foreign Application Priority Data

Jan. 13, 1986 [NL] Netherlands ..... 8600048

[51] Int. Cl.[5] ..... H05B 1/02; D06F 75/14; D06F 75/26; F22B 1/28

[52] U.S. Cl. ..... 219/251; 38/77.7; 38/77.8; 38/82; 219/255; 219/272; 219/275

[58] Field of Search ..... 219/245, 250–258, 219/271, 272, 275; 38/74, 75, 77.1–77.9, 82–87

[56] References Cited

U.S. PATENT DOCUMENTS

| | | | |
|---|---|---|---|
| 1,597,427 | 8/1926 | Brenizer | 38/77.6 |
| 1,676,098 | 7/1928 | Leprestre | 38/77.6 |
| 1,736,148 | 11/1929 | Brewer | 38/77.7 |
| 1,780,236 | 11/1930 | Klaren | 38/77.8 |
| 2,179,259 | 11/1939 | Jones | 38/77.8 |
| 2,345,413 | 3/1944 | Morton | 219/255 X |
| 2,387,757 | 10/1945 | Hoecker | 38/77.5 |
| 2,437,571 | 3/1948 | Waage | 38/77.82 |
| 2,499,835 | 3/1950 | Rakos | 38/77.7 |
| 2,612,709 | 10/1952 | Dafforn et al. | 219/255 X |
| 2,763,946 | 9/1956 | D'Alessandro | 38/77.7 |
| 2,829,452 | 4/1958 | Humphrey | 219/255 X |
| 3,263,350 | 8/1966 | Abraham . | |
| 4,571,862 | 2/1986 | Costa | 219/255 X |

FOREIGN PATENT DOCUMENTS

| | | | |
|---|---|---|---|
| 138775 | 4/1985 | European Pat. Off. . | |
| 2523164 | 9/1983 | France | 38/77.7 |
| 2543180 | 9/1984 | France | 38/77.7 |
| 59-139300 | 8/1984 | Japan | 38/77.7 |

*Primary Examiner*—Anthony Bartis
*Attorney, Agent, or Firm*—Ernestine C. Bartlett

[57] ABSTRACT

An electric steam iron includes a sole plate maintained at a temperature of about 200° C. by an about 800 watt electric heating element and provided with apertures for conveying steam to a surface to be ironed from a single flooded steam chamber on the iron maintained at about 100° C. by an about 1200 watt electric heating element through a steam tube connecting the chamber to the apertures. The article being ironed is heated continuously by the the condensation of the steam to water in the article thereby increasing heat transfer to the article, with the article being subsequently dried by the heat produced by the sole plate, which heat is at least equal to the heat of evaporation of the condensed water. The sole plate and chamber may be thermally connected to compensate for heat losses from the chamber to the environment.

17 Claims, 2 Drawing Sheets

ELECTRIC STEAM IRON WITH SEPARATELY HEATED SOLE PLATE AND STEAM CHAMBER

This is a continuation of application Ser. No. 876,542, filed Jun. 20, 1986, now abandoned.

The invention relates to a steam iron comprising a housing, a sole plate, a water reservoir, a steam chamber, and at least two heating elements of which at least one element serves for heating the sole plate.

Such a steam iron is disclosed in, for example, EP 0,138,775.

The steam irons available until now are constructed to heat the fabric to be ironed by contact of the fabric with the hot sole plate during ironing and at the same time flatten it by pressing. The temperature of the sole plate should be as high as possible for a maximum heat transfer. However, since not all kinds of fabrics can withstand high temperatures the sole plate temperature must be variable. This temperature is always set to the maximum temperature for a specific type of fabric in conformity with an international standard. The steam produced by steam irons using this principle serves to dampen the fabric to be ironed and, in principle, may be replaced by a cold-water spray or may even be dispensed with if the article to be ironed is predampened.

Owing to the thermal conductivity of textile fabrics the maximum heat delivered by a hot sole plate is approximately 1000 W at an ergonomically determined normal ironing rate. Therefore the power of commercially available flat irons lies between 800 W and 1200 W.

The domestic steam irons available until now comprise one heating element which heats the sole plate but which also delivers heat to the steam chamber near the sole plate in order to convert the water dripping into the steam chamber into steam. The rate at which water is supplied dictates the amount of steam being produced and the available power of the steam iron is divided to produce the heat delivered to the articles to be ironed via transfer through the sole plate and to evaporate water for steam production. However, the steam production should never become so large that less than the maximum usable amount of heat for heating the article to be ironed is available. Otherwise the sole plate will cool, resulting in a deteriorated ironing performance.

As already stated, domestic steam irons are known from the literature, which comprise two heating elements, of which one element serves for heating the sole plate and the other for steam production. It is also known to control these heating elements separately by means of a thermal switch, thereby preventing cooling of the iron in the case of a high steam production. An example of this is described in U.S. Pat. No. 3,263,350. Generally, such irons are based on the above described ironing principles. Generally the power to be delivered by the separate heating elements together or separately is not mentioned, except for the iron described in U.S. Pat. No. 2,437,571 where the heating element for steam production delivers approximately 300 W and that for sole-plate heating 600 to 1000 W.

In all the irons known until now it is attempted to optimize the ironing result by means of a specific design. When this principle is used and the customary test methods for the evaluation of steam irons are adapted, the best steam iron yields the best ironing performance in accordance with a standard wrinkle scale. This optimum result requires a comparatively long contact time of the fabric with the hot sole plate of the steam iron. This is due to the comparatively low thermal conductivity of textile fabrics. In order to transfer sufficient heat to the fabric and to prevent the fabric from being burnt owing to the long contact time, this contact is generally intermittent. This is the essence of the ironing movement which ensures that the article to be ironed comes as many times into contact with the sole plate as is required to transfer enough heat to warm up the fabric thoroughly.

In practice, it would be desirable to obtain the desired ironing result by one passage of the iron over the fabric at the customary ergonomically determined ironing speed. However, an analysis shows that for the customary ironing speeds and conductivity it is not possible to transfer more than 1000 W to the fabric via the sole plate during ironing. This is not adequate to fully warm up most types of fabric in one stroke before the iron has passed and hence flattening pressure on the fabric has ceased.

SUMMARY OF THE INVENTION

It is the object of the invention to improve a steam iron of the type defined in the opening paragraph in such a way that the heat transfer between the iron and the fabric is increased substantially.

To this end the invention is characterized in that the element(s) for steam production deliver(s) a higher power than the element(s) for sole-plate heating.

In accordance with the invention, the textile fabric is heated by means of steam which condenses to water in the cold fabric, covering the fabric to be heated to 100° C. over its entire thickness. This results in a substantially higher transfer of heat per unit of time to the fabric to be ironed than attainable by thermal conduction. Drying the steamed fabric in which a part of the steam being produced has condensed to form water is achieved by means of the "dry" heat delivered by the sole plate. Therefore, at least the heat of evaporation of the water which has condensed in the fabric should now be delivered to the fabric by the sole plate. Since this condensed steam is only a part of all the steam produced during heating of the fabric and since the heat of evaporation of water is equal to the heat of condensation of steam, the power to be delivered by the sole plate is less than half the total power to be delivered to the fabric by the steam iron. Thus, when the fabric is heated by means of condensing steam and is dried again by the heat delivered by the sole plate via conduction, the desired ironing performance can be achieved substantially more rapidly and can be achieved even in one stroke in the case of a well-designed iron in which the steam-production power and sole-plate heating power are adapted correctly to one another. Preferably, the total power of the heating elements is at least 1400 W.

If the fabric is to be heated to 100° C. by means of steam in one stroke of a steam iron having normal sole plate dimensions, i.e. approximately 10×20 cm, this requires a steam condensation of approximately 20 g/min. In order to achieve this the power required for heating the steam chamber is approximately 700 W and the drying power to be produced by the sole plate should therefore be approximately 700 W. This means that the sole-plate temperature should then be approximately 200° C.

However, during operation of a steam iron in accordance with the invention there are some inevitable losses. For example, not all the steam will condense in the textile fabric. During heating a part of the steam is blown through the fabric with force in order to heat the fabric through and through. Moreover, allowance must be made for the moisture already present in the textile fabric, which moisture should also be heated and evaporated. Further, the iron should not be operated constantly at full power. The heating elements should have a specific control range because the maximum amount of heat delivered should be higher than the average heat delivered during ironing. Should this not be the case the iron will no longer perform correctly for the heaviest jobs (thick fabrics), because of excessive cooling.

When allowance is made for these factors, the minimum total power of a flat iron in accordance with the invention will therefore be 1400 W. However, preferably the heating element for steam production will have a power of approximately 1200 W, while the element for sole-plate heating will have a power of approximately 800 W in order to maintain the sole-plate temperature at 200° C.

Surprisingly, it has been found that the risk of the fabric being scorched during ironing with an iron in accordance with the invention is substantially smaller than with a conventional steam-spray iron with the same sole-plate temperature. This advantage may turn into a disadvantage when the water in the steam chamber is running short, so that the steam supply to the fabric is discontinued. Therefore, in another preferred embodiment of the invention, the iron comprises an electric circuit with a thermal switch to interrupt the current through the two heating elements when the temperature of the steam chamber rises above 105° C. Thus the iron in accordance with the invention cannot be used for ironing when there is no water in the steam chamber.

Another preferred embodiment of the invention is characterized in that the iron comprises a manually actuated switch by means of which the current for heating the sole plate can be switched on separately, the temperature of the sole plate being limited to a fixed value below 100° C. by a second thermal switch. This enables the iron to be used for dry ironing. Even if there is no water in the steam chamber and, as a result of this, the current to both heating elements is interrupted, as is described in the preceding paragraph, the iron can be switched on by means of the switch for dry ironing, the sole plate temperature then being below 100° C., so as to preclude scorching of the fabric.

In order to enable the user to discern whether the iron is not heated because there is no power supply, for example as a result of a defective fuse or a socket, or because there is no or not enough water in the steam chamber and the circuits described above have consequently interrupted the power supply to the heating element, a further preferred embodiment of the invention comprises separate indicators which indicate whether the mains current to the iron or the current to the heating elements for the sole plate and/or the steam chamber is interrupted.

In another suitable embodiment of the invention the iron comprises a switch by means of which the current to the heating element of the steam chamber is interrupted when the temperature in the steam chamber exceeds 95° C. and no ironing is effected. The steam production is thus interrupted when no ironing takes place, which results in a substantial saving of power. However, the water in the steam chamber remains at approximately 95° C., so that the steam production is restored rapidly when ironing is continued.

An especially preferred embodiment of the invention is characterized in that the sole plate and the steam chamber are each maintained at a specific temperature by means of thermal switches and are thermally interconnected. The sole plate may then have, for example, a temperature of 200° C., whilst the temperature of the boiling water in the steam chamber is 100° C. This enables a continuous flow of heat from the sole plate to the steam chamber to be obtained, whose magnitude is accurately defined by the magnitude of the thermal contact between the sole plate and the steam chamber.

Preferably, the operating temperatures of the sole-plate and the steam chamber and the magnitude of the thermal contact are selected in such a way that the flow of heat from the sole-plate to the steam chamber is larger than or equal to the loss of heat from the steam chamber to its environment.

In the case of a well-designed iron the heat flow required for this is approximately 60 W and the thermal contact between the sole plate and the steam chamber at the given constant temperatures of the two elements can be made so as to obtain this heat flow. When the iron is not in use the sole plate can produce such a heat flow and will continue to do so during ironing. However, in the case of a well-designed iron in accordance with the present embodiment this requires an adequate power, i.e. at least 800 W.

An embodiment of the invention will now be described in more detail, by way of example, with reference to the accompanying drawings.

DESCRIPTION OF THE PREFERRED EMBODIMENT

Figure 1:
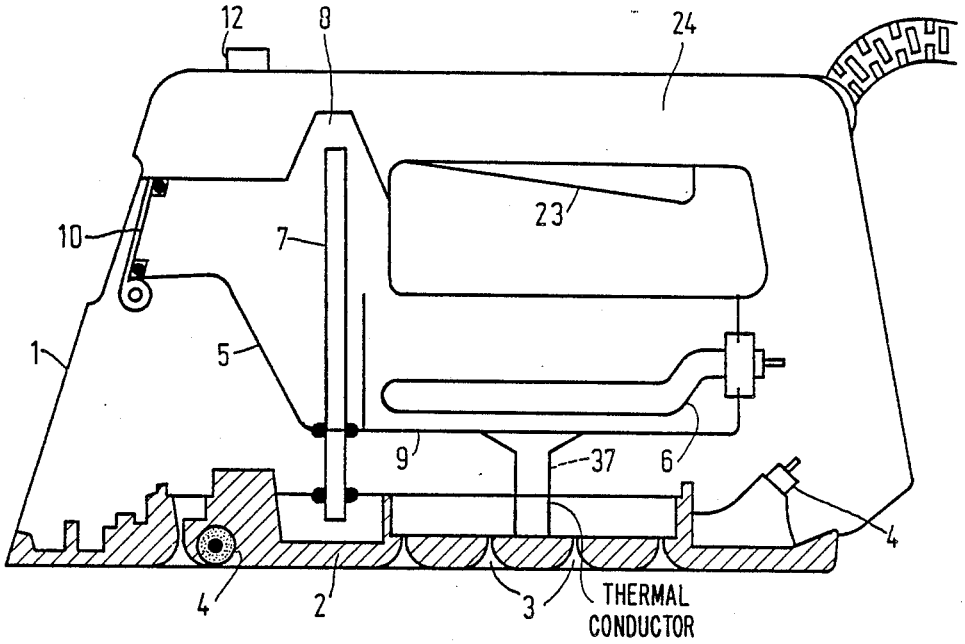
FIG. 1 schematically shows a steam iron in accordance with the invention.

The iron comprises a housing 1 which at its bottom is closed by a sole plate 2 formed with steam outlet apertures 3. A heating element 4 is situated in the sole plate. The iron further comprises a steam chamber 5 in which there is arranged another heating element 6 constructed as an immersion heating element. The steam chamber comprises a steam pipe 7 which extends from a steam dome or steam/water separator at the top of the chamber through the bottom of the chamber 5 to a level just above the sole plate near the steam outlet apertures 3. Further, the steam chamber comprises a filler cap 10 in which a safety valve is mounted.

In accordance with the invention the heating element 6 for steam production delivers a higher power than the heating element 4 for sole-plate heating and, suitably, the total power of these two heating elements together is at least 1400 W.

Figure 2:
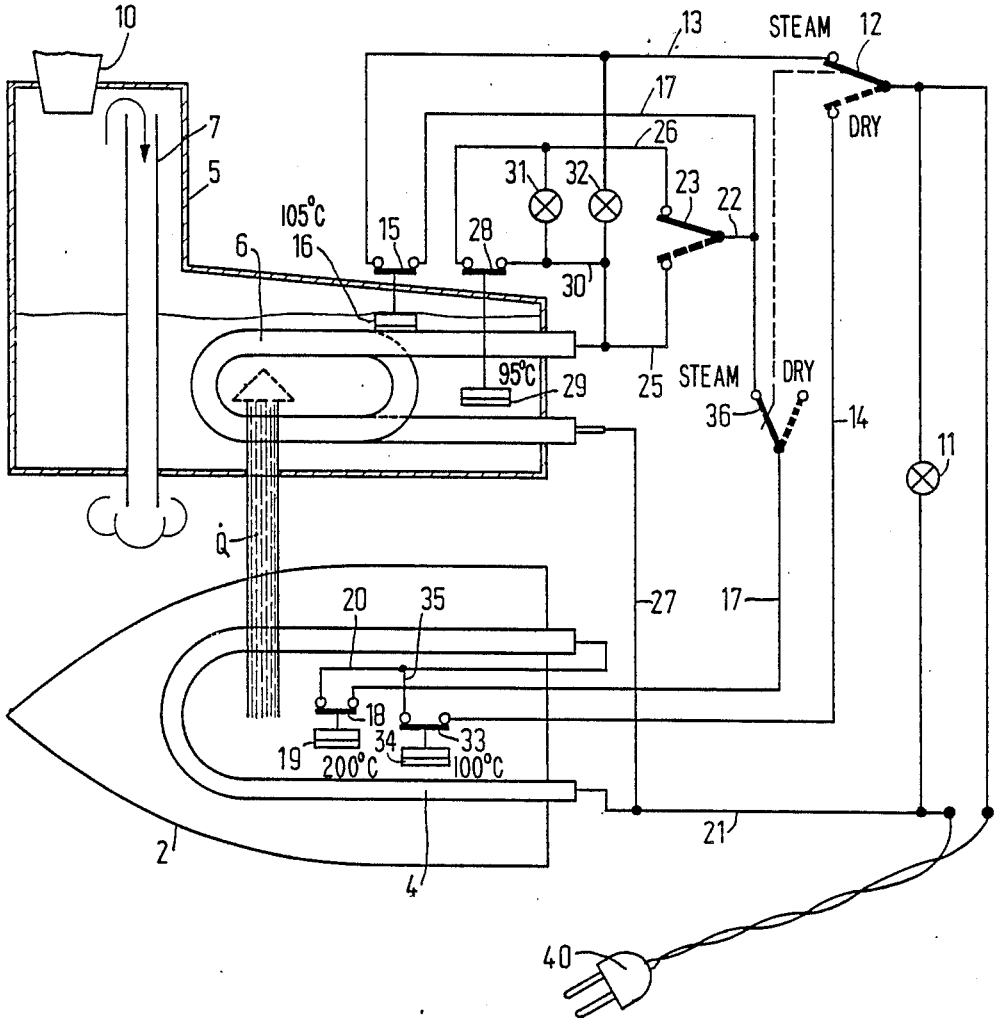
FIG. 2 is the electrical circuit diagram for the iron shown in FIG. 1.

FIG. 2 shows schematically an iron in accordance with the invention and the corresponding electrical circuit diagram. When the plug 40 is inserted into a mains socket and the circuit is energized, the lamp 11 will light up. By means of a manually actuated switch 12 on the iron it is possible to ensure that the current flows via the line 13 or via the line 14. Thus, it is possible to select steam ironing, in which case current will flow via the line 13, or dry-ironing, in which case current will flow via the line 14.

In the steam-ironing position a current flows to a switch of a first thermal element 16 via the line 13, which element is thermally connected to the heating element 6 of the steam chamber. The thermal element is set to approximately 105° C. This means that the switch 15 opens when the temperature of the heating element exceeds 105° C. This happens when the water in the chamber 5 has fallen below a specific minimum level. In practice, this means that the steam chamber should be replenished with water. If there is enough water in the steam chamber the switch 15 will be closed and current will flow to a switch 18 of a second thermal element 19 via the line 17, which second element is thermally connected to the sole plate 2. This second thermal element is set to approximately 200° C., i.e. the switch 18 opens when the sole-plate temperature exceeds 200° C. and is closed when the temperature decreases below 200° C. When the switch 18 is closed the current flows to the heating element 4 via the line 20 and back to the return line 21.

A part of the current in the line 17 flows to a microswitch 23 via a line 22. This switch is mounted in the handle 24 of the iron. The position of the switch 23 determines whether the current flows directly to the heating element 6 via the line 25 or indirectly to the heating element 6 via the line 26. If steam-ironing is required the handle 24 should be gripped, causing the microswitch 23 to be depressed automatically. Then a current flows to the heating element 6 via the line 25 and from said element back to the return line 21 via the line 27. As long as the microswitch is depressed the heating element 6 remains energized and the iron will produce steam provided that there is enough water in the tank 5. If the microswitch 23 is released, so that it springs back to its other position, current will flow to a switch 28 of a third thermal element 29 via the line 26. The thermal element 29 is immersed in the water of the steam chamber and is set to approximately 95° C., i.e. just below the boiling point of water. If the temperature is below 95° C., the switch 28 is closed and the current flows to the heating element 6 via the line 30. If the temperature is above 95° C. the switch 28 is open and only a small current flows to the heating element 6 via the lamp 31 arranged between the lines 26 and the line 30. When the switch 23 is depressed, this lamp is extinguished. The advantage of this section of the electric circuit comprising the thermal element 29 is that when the iron is not in use the water remains at a temperature near the boiling point and the steam production is restored immediately when the user wishes to continue ironing.

Another pilot lamp 32 is arranged between the line 13 and the line 30 to indicate whether there is still enough water in the steam chamber. The lamp 32 lights up when there is not enough water in the steam chamber. The switch 15 is then open and a small current flows from the line 13 to the line 30 via the lamp 32 and then to the return line 21 via the heating element 6 and the line 27.

In the dry-ironing position a current flows to a switch 33 of a fourth thermal element 34 via the line 14. This thermal element is thermally coupled to the sole plate 2 and is set to a temperature of approximately 100° C. If the temperature is below 100° C. the switch 33 is closed and current flows to the line 20 via the line 35 and then back to the line 21 via the heating element 4. In a closed position of the switch 33 it is also possible for a current to flow back to the steam-chamber heating element 6 via the closed switch 18 of the thermal element 19 and the line 17. In order to preclude this, another switch 36 is arranged in the line 17, which switch is coupled to the switch 12 in such a way that the switch 36 is closed when the switch 12 is set to steam-ironing and the switch 36 opens when the switch 12 is set to dry-ironing, so that no current can flow through the line 17.

In accordance with one of the characteristic features of the invention the sole plate 2 may be thermally connected to the steam chamber 5. In FIG. 1 this is indicated schematically by means of a rod 37 of a material having a high thermal conductivity, which at one end is thermally connected to the sole plate, for example by means of a screw-thread connection or in that it forms part of the sole plate itself, and which at the other end is rigidly connected to the bottom 9 of the steam chamber 5. This results in a heat flow Q from the hot sole plate to the water in the chamber. Preferably, this rod 37 is dimensioned so as to compensate for heat losses from the chamber to its environment. In FIG. 2 the heat flow Q is represented symbolically by an arrow.

What is claimed is:

1. A steam iron comprising:

a sole plate including a plurality of apertures for conveying steam to a surface to be ironed, said sole plate including an electric heating element which is adapted to maintain said sole plate at a predetermined temperature that is at least sufficient to evaporate water condensed in the article to be ironed; and a single flooded steam chamber for containing a supply of water and for continuously generating steam, said steam chamber including a separate electric heating element for heating all the water in said steam chamber to form steam, and a steam tube for separating water from steam and for continuously conveying steam to said sole plate apertures, said steam chamber heating element generating more heat than said sole plate heating element, the combined heating power of said heating elements exceeding 1400 watts, circuit means for energizing said heating elements to continuously generate steam and to heat said sole plate to said predetermined temperature, whereby an article being ironed is heated by steam continuously produced in said chamber and continuously discharged through said apertures into contact with the article, the steam condensing to water in the article thereby increasing heat transfer to the article, the article being subsequently dried by the heat produced by said sole plate, the amount of heat produced by said sole plate being equal to at least the heat of evaporation of water condensed in the article being ironed.

2. A steam spray iron as claimed in claim 1, wherein the iron comprises an electric circuit with a thermal switch responsive to the temperature in the steam generator for interrupting the current through the two heating elements when the temperature of the steam chamber rises above 105° C.

3. A steam iron as claimed in claim 1, wherein the iron comprises a manually actuated switch by means of which the current for energizing the sole plate heating element can be switched on separately.

4. A steam iron as claimed in claim 1, wherein the iron comprises separate indicators which indicate whether mains current to the iron, or the current to the heating elements for the sole plate and the steam chamber is interrupted.

5. A steam iron as claimed in claim 1, wherein said circuit means includes a thermal switch responsive to the temperature of the steam chamber for interrupting the current to the heating element of the steam chamber when the temperature of the steam chamber exceeds 95° C. and the iron is not in use.

6. A steam iron as claimed in claim 1, wherein the sole plate and the steam chamber are each maintained at a specific temperature by means of thermal switches responsive respectively to the temperature of the sole plate and the stem chamber and said chamber and said sole plate are thermally interconnected.

7. A steam iron as claimed in claim 1, wherein the operating temperatures of the sole plate and the steam chamber and the magnitude of the thermal interconnection are selected in such a way that the flow of heat from the sole plate to the steam chamber is at least equal to the loss of heat from the steam chamber to its environment.

8. A steam iron as claimed in claim 1, wherein said circuit means includes a thermal switch responsive to the temperature of the steam chamber for interrupting the current to the heating element of the steam chamber when the temperature of the steam chamber exceeds 95° C. and the iron is not in use and a switch for automatically bypassing said thermal switch when the iron is being used.

9. A steam iron comprising:

a sole plate including a plurality of apertures for conveying steam to a surface to be ironed, said sole plate including an electric heating element having a heating power of about 800 watts which is adapted to maintain said sole plate at a predetermined temperature that is at least sufficient to evaporate water condensed in the article to be ironed, a single, flooded steam chamber for containing a supply of water and for continuously generating steam, said steam chamber including a separate electric heating element having a heating power of about 1200 watts for heating the water in said steam chamber to form steam, and a steam tube for continuously conveying steam to said sole plate apertures, whereby an article being ironed is heated by steam continuously produced in said chamber and continuously discharged through said apertures into contact with the article and which condenses to water in the article, thereby increasing the transfer of heat per unit of time to the article being ironed and whereby said article is subsequently dried by the heat produced by said sole plate, the amount of heat produced by said sole plate being equal to at least the heat of evaporation of water condensed in the article;

an electric circuit with a switch responsive to the temperature of the steam in the steam generator for interrupting the current through the two heating elements when the temperature in the steam chamber rises above the 105° C.; and circuit means for simultaneously energizing said heating elements to continuously generate steam and heat said sole plate to said predetermined temperature.

10. A steam iron as claimed in claim 9 wherein the circuit for energizing the heating elements includes means whereby the temperature of the boiling water in the steam chamber is maintained at 100° C. and the temperature of the sole plate is maintained at 200° C.

11. A steam iron as claimed in claim 9, wherein the iron comprises a manually actuated switch by means of which the current for energizing the sole plate heating element can be switched on separately.

12. A steam iron as claimed in claim 9, wherein the circuit means includes a thermal switch responsive to the temperature of the steam chamber for interrupting the current to the heating element of the steam chamber when the temperature of the steam chamber exceeds 95° C. and the iron is not in use.

13. A steam iron as claimed in claim 9 wherein the sole plate and the steam chamber are thermally interconnected and are each maintained at selected temperatures by means of thermal switches responsive respectively to the temperature of the sole plate and steam chamber, the magnitude of the thermal interconnection being selected so that the flow of heat from the sole plate to the steam chamber is at least equal to the loss of heat from the steam chamber to its environment.

14. A steam iron comprising:

a sole plate including a plurality of apertures for conveying steam to a surface to be ironed, said sole plate including an electric heating element having a heating power of about 800 watts which is adapted to maintain said sole plate at a temperature of about 200° C.;

a steam chamber for containing a supply of water and for continuously generating steam, said steam chamber including a separate electric heating unit having a heating power of about 1200 watts for heating and maintaining the water in the steam chamber at a temperature of about 100° C. to form steam and a steam tube for continuously conveying steam to said sole plate apertures, whereby an article being ironed is heated by steam continuously produced in said chamber and continuously discharged through said apertures into contact with the article and which condenses to water in the article thereby increasing the transfer of heat per unit of time to the article during ironing and whereby said article is subsequently dried by the amount of heat produced by said sole plate which amount is at least equal to the heat of evaporation of water condensed in the article;

an electric circuit with a switch responsive to the temperature of the steam in the steam generator for interrupting the current through the two heating elements when the temperature in the steam chamber rises above about 105° C.;

a manually actuated switch by means of which the current for energizing the sole plate heating element can be switched on separately;

and a thermal element responsive to the temperature of the sole plate for fixing the temperature of the sole plate to a fixed value below 100° C. when the current through the two heating elements is interrupted because the temperature in the steam chamber rises above about 105° C.

15. A steam iron as claimed in claim 14 wherein the circuit includes a thermal switch responsive to the temperature in said steam chamber for interrupting current to the heating element of the steam chamber when the temperature of the steam chamber exceeds 95° C. and no ironing is taking place; and a switch for automatically bypassing said thermal switch when the iron is being used.

16. A steam iron as claimed in claim 14 wherein the sole plate and the steam chamber are thermally interconnected and are maintained at said temperatures by thermal switches responsive to the respective temperature of the sole plate and the steam chamber, the magnitude of the thermal interconnection being preselected to effect a flow of heat from the sole plate to the steam chamber that is at least equal to the loss of heat from the steam chamber to its environment.

17. A steam iron as claimed in claim 14 wherein the iron comprises separate indicators which indicate whether a mains current to the iron, or the current to the heating elements for the sole plate and the steam chamber is interrupted.

* * * * *